US005406241A

United States Patent [19]

Kawamura

[11] Patent Number: 5,406,241

[45] Date of Patent: Apr. 11, 1995

[54] ELECTROMAGNETIC VALVE ACTUATING SYSTEM

[75] Inventor: Hideo Kawamura, Kanagawa, Japan

[73] Assignee: Isuza Ceramics Research Institute Company, Inc., Kanagawa, Japan

[21] Appl. No.: 68,612

[22] Filed: May 27, 1993

Related U.S. Application Data

[63] Continuation of Ser. No. 789,591, Nov. 8, 1991, abandoned.

[30] Foreign Application Priority Data

Nov. 8, 1990 [JP] Japan ..... 2-303236

[51] Int. Cl.[6] ..... H01F 7/08

[52] U.S. Cl. ..... 335/227; 251/129.09

[58] Field of Search ..... 335/227, 177–179; 251/129.01, 129.21

[56] References Cited

U.S. PATENT DOCUMENTS

| | | | |
|---|---|---|---|
| 4,614,170 | 9/1986 | Pischinger et al. | 123/90.11 |
| 4,708,317 | 11/1987 | Hiyama | 251/129.16 |
| 4,829,947 | 5/1989 | Lequesne | 251/129.1 |
| 5,009,202 | 4/1991 | Kawamura | 251/129.1 |
| 5,095,856 | 3/1992 | Kawamura | 251/129.01 |
| 5,124,598 | 6/1992 | Kawamura | 251/129.1 |

FOREIGN PATENT DOCUMENTS

| | | |
|---|---|---|
| 2-173306 | 4/1990 | Japan . |
| 3-092517 | 4/1991 | Japan . |
| 3-092520 | 4/1991 | Japan . |
| 3092518 | 4/1991 | Japan . |

*Primary Examiner*—Lincoln Donovan
*Attorney, Agent, or Firm*—Staas & Halsey

[57] ABSTRACT

An apparatus for driving valve by electromagnetic force, for an engine capable of being installed in a narrower space due to the interfering object or narrow arrangement pitch of a supply/exhaust valve, comprises: a fixed magnetic pole which is wound with the primary coils and which is opposingly disposed embracing the secondary coils in the perpendicular direction to the reciprocating direction of the secondary coils; an air gap adjacent with a tip end of the fixed magnetic pole and provided in the middle of a magnetic flux path generated from the primary coil; a movable element adapted to be made of magnetic substance, to move freely reciprocating in the air gap, to form part of the magnetic flux path, and to contain the secondary coils.

25 Claims, 3 Drawing Sheets

ELECTROMAGNETIC VALVE ACTUATING SYSTEM

This application is a continuation of application Ser. No. 07/789,591, filed Nov. 8, 1991, now abandoned.

BACKGROUND OF THE INVENTION

1. Field of the Invention

The present invention relates to an electromagnetic force valve driving apparatus capable of driving open and closed a supply/exhaust valve of an engine by an electromagnetic force.

2. Description of the Related Art

In opening/closing drive apparatuses of the conventional supply/exhaust valves, the supply/exhaust valves are adapted to always be biased in the closed direction by a spring. The supply/exhaust valves are driven to open and close by depressing each shaft end face of the valves through a link mechanism such as a rocker arm, a pushing rod and the like from a cam surface of a cam shaft which is driven by an output shaft of an engine and is rotated synchronously in phase with rotation of the engine.

An engine configuration of the opening/closing drive apparatus requires as described above a larger size engine due to provision of the cam shaft and link mechanism within the engine. Also friction resistance on driving the cam shaft and link mechanism provides partial dissipation of engine output, lowering effective engine-output.

Since the open/close timing of the supply/exhaust valve is impossible to vary easily during operation of the engine, the open/close timing of valve must be adjusted to optimize its running condition at a specific rotation speed of the engine. Accordingly when running at a rotation speed differing from the specified one, it is impossible to obtain satisfactory output and efficiency which the engine intrinsically exhibits.

To solve the problem as hereinbefore described, unlike the open/close drive of the supply/exhaust valve by cam shaft, various kinds of valve drive apparatuses are disclosed in the Japanese Patent Application Laid Opens No. 183805 in 1983 and No. 76713 in 1986, such that the valve drive apparatuses are adapted to open and close the supply/exhaust valve capable of varying the opening/closing timing thereof by means of attracting movable magnetic poles connected to the supply/exhaust valve using an electromagnetic force of a magnet fixed on the engine.

When the engines are actually applied with the conventional valve drive apparatuses adapted to drive opening/closing of the supply/exhaust valve by electromagnetic force as hereinbefore described, then a construction capable of generating a very strong magnetic force is required for reliably driving the supply/exhaust valve and for enabling operation in a region of high speed rotation.

A requirement of generating very strong magnetic force results in enlarging a magnetic flux density and thus expanding a cross section of a magnetic path.

The expanded cross sections of a magnetic path create interference between the adjacent drive apparatuses of the supply/exhaust valves. Therefore, these adjacent drive apparatuses can not be accommodated in an engine.

The problems as hereinbefore described are not solved in the Japanese Patent Application Laid opens as in the foregoing because they do not teach arrangements employing a narrower pitch for installation of the supply/exhaust valve or in assembling the drive apparatus in a narrow space.

The present invention is made in the light of the problems described above, and an object of the invention is to provide an apparatus for electromagnetic force valve driving apparatus capable of generating very strong electromagnetic force even when in a narrow pitch for installation of the supply/exhaust valve and in assembling within a narrow space due to a barrier or an interfering object.

SUMMARY OF THE INVENTION

An apparatus for driving an electromagnetic force valve in accordance with the present invention drives a supply/exhaust valve by an electromagnetic force acting between primary coil and secondary coils, the primary coil being fixed on an engine and generating magnetic flux, and the secondary coils capable of reciprocating movement being connected to the supply/exhaust valve and capable of inducing current by the flux. The electromagnetic force valve driving apparatus in accordance with the present invention includes a fixed magnetic pole which is wound with the primary coils and opposingly disposed to embrace the secondary coils in the perpendicular direction to the reciprocating movement direction of the secondary coils. The present invention also includes air gap adjacent to a tip end of the fixed magnetic pole and provided on any position of a magnetic flux path generated from the primary coil, and movable element made of magnetic substance, and movable reciprocatingly in the air gap, to form part of the magnetic flux path, and to contain the secondary coils. Thus an object of the present invention is achieved.

An electromagnetic force valve driving apparatus provided with the constitution as hereinbefore described, since a fixed magnetic pole is provided opposingly embracing the primary coil, the width of the perpendicular direction to the opposing direction of the fixed magnetic pole is reduced to enable installation in a narrower space and a very strong electromagnetic force is allowed to exert on the movable element in good balance. In this way, the present invention can provide an apparatus for driving a valve by electromagnetic force capable of generating a very strong electromagnetic force even in the arrangement of the supply/exhaust valve with narrower installation pitch or in assembling in a very narrow space due to an interfering object because the width of the perpendicular direction to the opposing direction of the fixed magnetic pole is reduced to enable installation in the narrower space. Also, the present invention allows very strong electromagnetic force to be exerted on the movable element in good balance since the fixed magnetic pole is opposingly arranged embracing the primary coil.

DESCRIPTION OF THE PREFERRED EMBODIMENTS

The present invention will be described in detail for embodiments with reference to the accompanying drawings as follow, wherein like numerals refer to like parts throughout.

Figure 1:
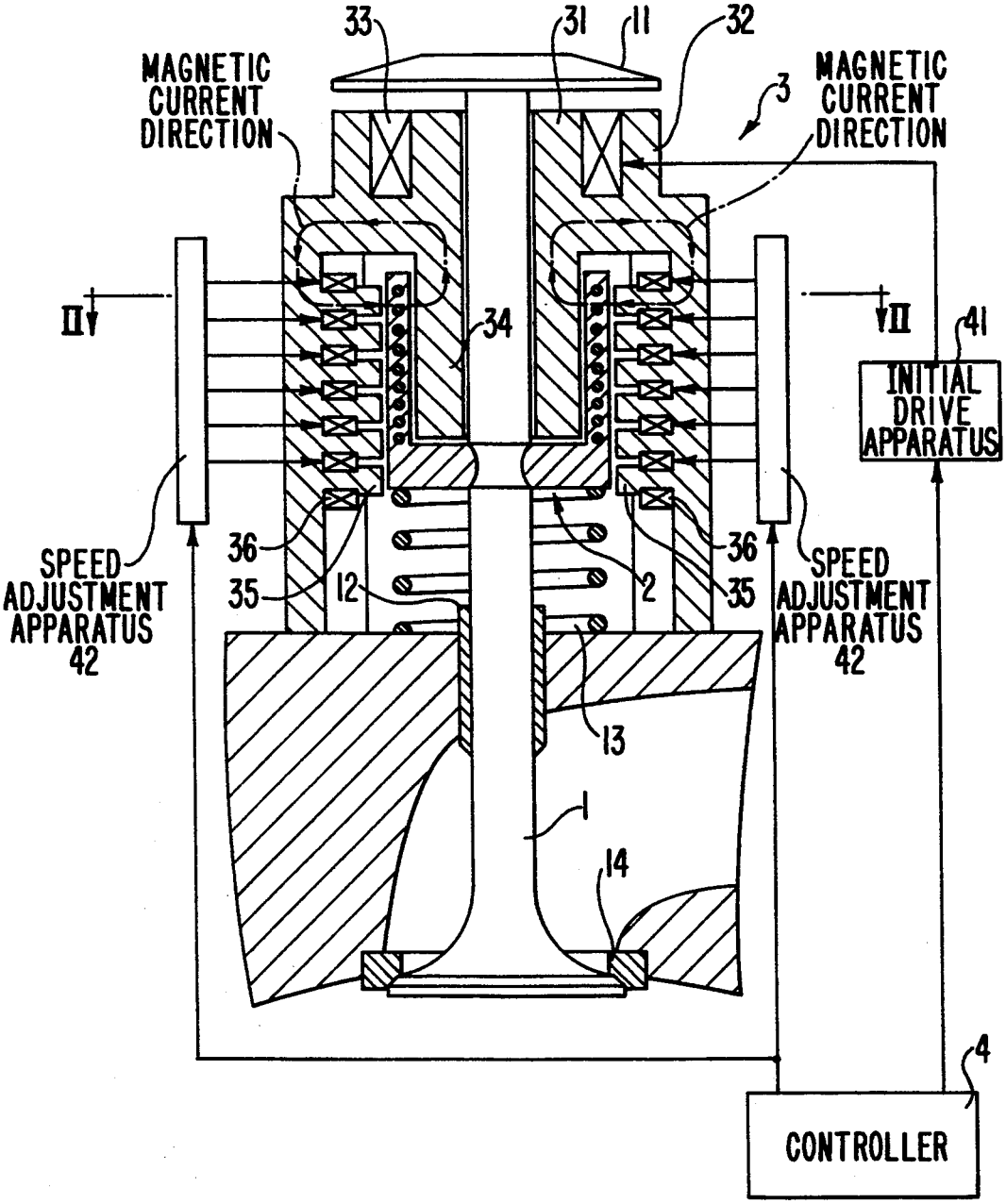
FIG. 1 is a block diagram showing the constitution of an electromagnetic force valve driving apparatus according to the present invention.
Figure 2:
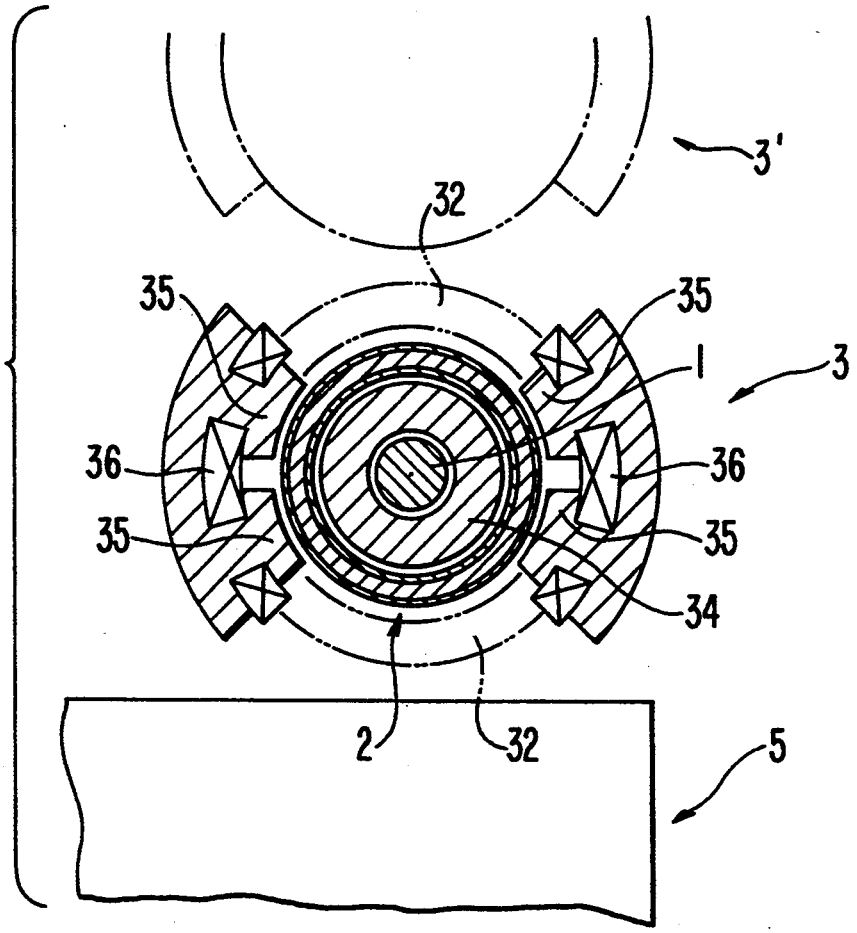
FIG. 2 is a sectional view taken along line II—II in FIG. 1.

FIG. 1 is a block diagram showing a constitution of an apparatus for driving a valve by electromagnetic force according to the invention. FIG. 2 is a sectional view taken along line II—II in FIG. 1. A supply valve and an exhaust valve are provided in an engine as hereinbefore described. However since the driving apparatus in accordance with the present invention can be applied to both of the supply valve and the exhaust valves, then hereinafter the apparatus for opening and closing the supply valve will be essentially described.

Numeral 1 is a supply valve made of ceramic material such as silicon nitride etc which is light in weight and excellent in strength in higher temperature. A movable magnetic pole 11 of disk shape is connected to a shaft end of the supply valve 1. The movable magnetic pole 11 is formed to be thinner in thickness as the distance from its center toward peripheral portions increases. The area of magnetic path formed between the movable magnetic pole 11 and a fixed magnetic pole described later is set uniform from the center to the peripheral portions.

The supply valve 1 is capable of freely reciprocating by a valve guide 12, and during the closing of the supply valve 1 an umbrella-shape portion of the supply valve 1 sits on a valve seat 14 to close a supply port.

A movable element 2 as described later is connected in the vicinity of center of a shaft portion of the supply valve 1. During the time when the engine is not operated, the movable element 2 is biased in the closing direction by a spring 13 to prevent the supply valve 1 from coming down.

Numeral 3 depicts a drive assembly. As in the drawing of the drive assembly 3, the upper end portion is provided with a fixed magnetic pole 31 of ring shape opposing to the lower center portion of the movable magnetic pole 11 and a fixed magnetic pole 32 of ring shape opposing to the lower face peripheral portion of the movable magnetic pole 11. The fixed magnetic poles 31 and 32 are concentrically disposed. An exciting coil 33 for exciting the magnetic poles 31 and 32 is arranged in a ring shape groove formed by the magnetic poles 31 and 32.

The fixed magnetic pole 31 is peripherally disposed with very small space apart from the outer circumference surface of the shaft portion of the supply valve 1. A center magnetic pole 34 is provided extending in the lower direction of the fixed magnetic pole 31.

The center magnetic pole 34 is formed in a cylindrical configuration and is arranged at a portion surrounding the shaft of the supply valve 1. The outer circumference of the center magnetic pole 34 is opposed to the inner circumference of the movable element 2.

In the drive assembly 3, there are provided two rows of stator magnetic poles 35 opposing each other at two positions through the outer circumference of the center magnetic pole 34 and the movable element 2, or opposing each other embracing the movable element 2. The stator magnetic poles 35 are provided in a plurality of stages in the reciprocating direction of the movable element 2. The stator magnetic poles 35 are wound with a primary coil 36 and flux density and flux direction respectively passing through the stator magnetic poles 35 are controlled at the respective stage basis. FIG. 1 shows part of the flux flow generated from the stator magnetic poles 35 with an arrow mark.

Numeral 4 depicts a controller comprising an input/output interface controlling the input/output of signals, a ROM storing a program or various related maps, a CPU executing computation with reference to the program stored in said ROM, a RAM temporarily storing computed result or data, a control memory controlling signal flow within the controller 4, and can include other components.

An initial drive apparatus 41 and a speed adjustment apparatus 42 are connected to the controller 4. The initial drive apparatus 41 is connected to the exciting coil 33. When the control signal from the controller 4 is inputted to the exciting coil 33, the exciting coil 33 receives power and excites the fixed magnetic poles 31 and 32.

The speed adjustment apparatus 42 is connected in each stage basis to the primary coil 36. With the speed control signals being inputted from the controller 4, the speed adjustment apparatus 42 supplies AC power of different phases in every stage of the primary coil 36 to form a travelling magnetic field by the flux passing through the stator magnetic poles 35, the travelling magnetic field being controlled of its travelling speed and direction.

In FIG. 2, numeral 3′ depicts another supply valve provided adjacent with the supply valve 1 or the drive assembly for driving the supply valve. The drive assembly 3 and the drive assembly 3′ are arranged so that respective lines including points where the fixed magnetic poles 35 are located may be in parallel as shown in the drawing. Thus, the installation pitch of the drive assemblies 3 and 3′ may be reduced.

Numeral 5 depicts a barrier limiting a location in mounting the drive assembly 3. As in the drawing, the location the supply valve 1 may be nearer to the barrier 5 by making the lines connecting the fixed magnetic poles 35 parallel with the wall face of the barrier 5.

Next the movable element 2 is explained.

Figure 3:
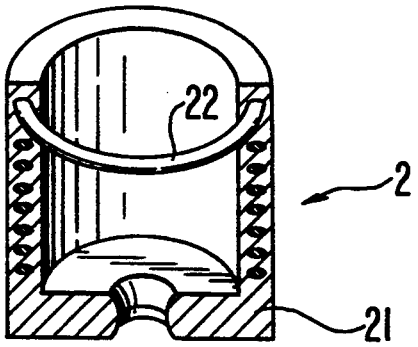
FIG. 3 is a sectional perspective view of a moving element of an electromagnetic force valve driving apparatus.

FIG. 3 is a perspective sectional view of the movable element.

The movable element 2 is in a cup configuration or in the form of cylindrical shape with a bottom. The movable element 2 comprises: a core 21 made of composite material including magnetic substance powder and plastic; a plurality of secondary coils 22 with closing ring configurations held by the core 21.

The magnetic substance powder included in the core 21 is formed of, for example, short fiber of silicon steel or fine grain of the same. The magnetic substance powder being kneaded with the plastic before hardening of the plastic, and resultant mixed substance is filled in the mold arranged with the second coils 22 on specified positions, to form the movable element 2.

The movable element 2 may also be formed, alternatively, by means of heating the plastic to melt after filling into mold by mixing plastic powder of thermal plasticity with magnetic substance powder.

Due to the required light weight, the secondary coils 22 are formed of, for example, electrically conductive metallic material such as aluminium and the like having smaller specific gravity or otherwise of conductive ceramic.

The movable element 2 thus produced has excellent magnetic permeability with light weight, therefore inertia mass of reciprocating drive system of the supply valve 1 may be greatly reduced.

Next, the apparatus according to the invention using the construction described above is described as follows.

Figure 4:
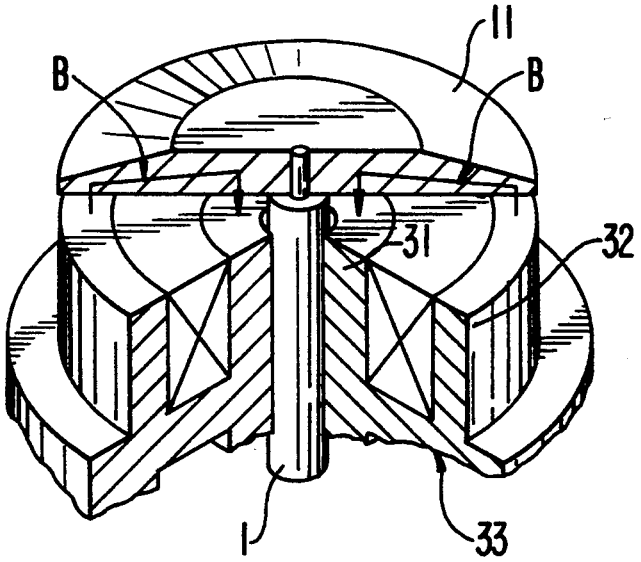
FIG. 4 is an illustration showing magnetic flux exerting on a movable magnetic pole of an apparatus for driving an electromagnetic force valve driving apparatus according to the invention.

During the time when the engine is operated, the controller 4 is always continuing to detect rotation phase of the engine and its load, a computation being made for the opening/closing timing and the lift amount of the supply valve corresponding to the engine load. When an actual rotational phase of the engine reaches the calculated opening/closing timing of the supply valve, the controller 4 outputs control signals to an initial drive apparatus 41. In this operation, the exciting coil 33 receives power to excite the fixed magnetic poles 31 and 32. FIG. 4 illustrates a profile where the fixed magnetic pole 31 is excited to S polarity and the magnetic pole 32 to N polarity.

FIG. 4 is an illustration of the flux exerting on a movable magnetic pole.

In the drawing, arrow mark B indicates flux travelling. As shown in the drawing, the fixed magnetic pole 32 emits the flux which travels through inside the movable magnetic pole 11 to form magnetic path continuing into the fixed magnetic pole 31. From this operation, the movable magnetic pole 11 is attracted to all the circumferences of the fixed magnetic poles 31 and 32, a very strong initial driving force may thus be produced even when the diameter of the movable magnetic pole 11 is smaller than the external diameter where the stator magnetic poles 35 are provided.

When the movable magnetic pole 11 has a constant thickness, magnetic flux density inside the movable magnetic pole 11 becomes smaller at the outer circumference thereof than the center portion. Accordingly, attracting force is not reduced even when the constant magnetic flux density between the central portion and the outer circumference portion is made constant by decreasing thickness of the outer circumference as in the drawing.

Further with such thinner thickness used, the reciprocating movement system of the supply valve 1 has a reduced inertia mass, so that a larger acceleration is thus realized.

When the exciting coil 33 receives electric power and initially drives the supply valve 1, the supply valve is driven up to the lift amount computed as hereinbefore described. The supply valve 1 is adjusted of its moving speed so as to sit the supply valve 1 on the valve seat 14 using the closing timing further calculated. An adjustment of moving speed is performed by outputting speed control signals to the speed adjustment apparatus 42 from the controller 4 as described above.

The spring 13 holding the supply valve 1 at a closing state has a biasing force being set satisfactorily smaller against the electromagnetic force.

While the present invention has been explained in detail and described with reference to preferred embodiments thereof, since the invention is readily capable of other various embodiments without departing from the spirit of the invention, the present invention is not restricted to any particular embodiments other than the scope of the appended claims in the invention.

I claim:

1. An apparatus for driving a supply/exhaust valve by an electromagnetic force acting between a primary coil and a secondary coil, the primary coil being fixed on an engine and generating magnetic flux, the secondary coil capable of reciprocating movement induced by said flux and being connected to a supply/exhaust valve, comprising:

a fixed magnetic member wound with the primary coil and opposing the secondary coil in a perpendicular direction to a reciprocating direction of the secondary coil; and a movable element including a magnetic substance, capable of reciprocating in an air gap defined adjacent to an end of said fixed magnetic member, and provided in a middle of a magnetic flux path generated by the primary coil, said movable element forming a part of the magnetic flux path, and containing the secondary coil.

2. An apparatus as claimed in claim 1, wherein a plurality of secondary coils are provided aligned in the reciprocating movement direction thereof.

3. An apparatus as claimed in claim 1, wherein the supply/exhaust valve is made of ceramic having relatively high strength and light weight.

4. An apparatus comprising:

a valve having a stem and an end member;

an element coupled to said valve, having at least one coil arranged in approximate concentricity about the stem;

a first at least one electromagnet arranged to oppose the end member; and a second at least one electromagnet arranged to oppose movement of the element in the direction of the valve stem, wherein the second at least one electromagnet provides a speed adjustment of said valve by inducing a current in the at least one coil.

5. An apparatus as claimed in claim 4, wherein the first at least one electromagnet provides an initial driving force to said valve by attracting the end member.

6. An apparatus as claimed in claim 4, wherein said element includes a composite material formed of magnetic substance powder and plastic, in which the at least one coil is fixed.

7. An apparatus as claimed in claim 4, wherein the second at least one electromagnet generates a magnetic flux in the at least one coil in a first direction approximately parallel to a second direction of reciprocation of said valve.

8. An apparatus as claimed in claim 4, wherein the first at least one electromagnet is arranged in approximate concentricity about the stem.

9. An apparatus as claimed in claim 4, wherein the end member has a disk shape which tapers in thickness near an edge thereof.

10. An apparatus as claimed in claim 4, wherein the end member has disk shape with a first radius, wherein the first at least one electromagnet is arranged in concentricity about the stem, and wherein the first at least one electromagnet has a second radius which is not substantially larger than the first radius.

11. An apparatus comprising:

a valve having a stem; and an element coupled to said valve, having at least one coil arranged in approximate concentricity about the stem, said element including a composite material formed of magnetic substance powder and plastic, in which the at least one coil is fixed.

12. A system comprising:

a first valve unit including a first valve having a first stem, a first element coupled to the first valve, having a first at least one coil arranged in approximate concentricity about the first stem, and a first at least one electromagnet having a first radial width and a first arcuate shape arranged to oppose the first element; and a second valve unit including a second valve having a second stem, a second element coupled to the second valve, having a second at least one coil arranged in approximate concentricity about the second stem, a second at least one electromagnet having a second radial width and a second arcuate shape arranged to oppose the second element, a spacing between said first valve unit and said second valve unit being less than a sum of the first and second radial widths.

13. A system comprising:

a first valve unit including a first valve having a first stem and a first end member, a first element coupled to the first valve, having a first at least one coil arranged in approximate concentricity about the first stem, a first at least one electromagnet having a first radial width and a first arcuate shape arranged to oppose the first element, a second at least one electromagnet having a second radial width and a second arcuate shape and arranged to oppose the first end member; and a second valve unit including a second valve having a second stem and a second end member, a second element coupled to the second valve, having a second at least one coil arranged in approximate concentricity about the second stem, a third at least one electromagnet having a third radial width and a third arcuate shape arranged to oppose the second element, and a fourth at least one electromagnet having a fourth radial width and a fourth arcuate shape and arranged to oppose the second end member, a spacing between said first valve unit and said second valve unit being less than a sum of the first and third radial widths, and the spacing being less than a sum of the second and fourth radial widths.

14. An apparatus as claimed in claim 4, wherein the at least one coil is formed within the element.

15. An apparatus as claimed in claim 14, wherein the at least one coil is molded within the element.

16. An apparatus as claimed in claim 6, wherein the at least one coil is a metallic material.

17. An apparatus as claimed in claim 16, wherein the metallic material includes aluminum.

18. An apparatus as claimed in claim 11, wherein the at least one coil is formed within the element.

19. An apparatus as claimed in claim 18, wherein the at least one coil is molded within the element.

20. An apparatus as claimed in claim 11, wherein the at least one coil is a metallic material.

21. An apparatus as claimed in claim 20, wherein the metallic material is aluminum.

22. A system as claimed in claim 12, wherein the first at least one coil and the second at least one coil include respective metallic materials.

23. A system as claimed in claim 22, wherein the first at least one coil is molded within the first element, and wherein the second at least one coil is molded within the second element.

24. A system as claimed in claim 13, wherein the first at least one coil and the second at least one coil include respective metallic materials.

25. A system as claimed in claim 23, wherein the first at least one coil is molded within the first element, and wherein the second at least one coil is molded within the second element.

* * * * *